United States Patent [19]

Berger

[11] Patent Number: 4,522,055

[45] Date of Patent: Jun. 11, 1985

[54] BENDING TOOL

[75] Inventor: Eric V. Berger, Brookline, Mass.

[73] Assignee: GTE Laboratories Incorporated, Waltham, Mass.

[21] Appl. No.: 548,257

[22] Filed: Nov. 2, 1983

[51] Int. Cl.[3] ..... B21D 31/00

[52] U.S. Cl. ..... 72/477; 140/106; 81/487

[58] Field of Search ..... 72/476, 477, 479; 81/3 R; 140/105, 106

[56] References Cited

U.S. PATENT DOCUMENTS

| | | | |
|---|---|---|---|
| 1,899,281 | 2/1933 | Lidseen | 72/157 |
| 3,172,452 | 3/1965 | Bryant | 72/477 |
| 3,299,681 | 1/1967 | Hautau | 72/156 |
| 3,400,570 | 9/1968 | Schellhammer | 72/479 |

*Primary Examiner*—Francis S. Husar
*Assistant Examiner*—David B. Jones
*Attorney, Agent, or Firm*—Fred Fisher

[57] ABSTRACT

A bending tool for semi-rigid coaxial cable makes bends possible with minimal damage to the cable. The tool contains two separate and independent series of superimposed cylindrical portions of gradually diminishing diameters along a linear path, oppositely directed away from a central support portion. Each of the cylindrical portions of one series is formed with a circumferential groove of like width and depth. Each of the cylindrical portions of the second series is formed with a circumferential groove of like width and like depth, but different from that of the one series.

4 Claims, 4 Drawing Figures

BENDING TOOL

BACKGROUND OF THE INVENTION

1. Field of the Invention

This invention relates to bending tools, and, in particular, to bending tools for semi-rigid coaxial cable. Accordingly, it is a general object of this invention to provide new and improved tools of such character.

2. Description of the Prior Art

Previously, semi-rigid coaxial cables were bent around any cylindrical object of the approximate size needed. Disadvantageously, this tended to produce flattened areas on the coaxial cables, causing transmission line discontinuities.

Hinsey, U.S. Pat. No. 506,234, discloses a tool with telescoping shafts of different diameters secured to a table.

Benson, U.S. Pat. No. 706,010, discloses pipe bending apparatus including a base having a series of holes of gradually increasing diameter for engaging pipe ends, a block with quadrantal peripheral grooves of increasing diameter, and a hinged lever having notches adapted to register with the grooves.

Brown, U.S. Pat. No. 885,139, discloses a pipe bender in which the pipe is placed between a grooved semi-cylinder and a grooved pillar. The semi-cylinder has two sets of grooves for pipes of various gages. The pillar is reversible, with two sets of grooves corresponding to those in the semi-cylinder.

Hinson, U.S. Pat. No. 1,264,519, discloses a ring mandrel consisting essentially of a conical shaped member having a series of concentrics dividing the entire surface into a series of cylindrical sections, each adapted to form and shape a ring of certain diameter.

Pardue, Jr., et al., U.S. Pat. No. 2,796,910, discloses a pipe bending machine including a cone-shaped bending die, and means for forcing a pipe to be bent into a die bed or insert therein. The bending die is provided with three groups of circumferentially spaced die beds or grooves, each bed extending circumferentially about the conical die through an arc of ninety degrees. Thus, at any given radius of turn, the die bed of each group has a different diameter bed from the other two beds. Insert shoes are releasably secured in the beds.

SUMMARY OF THE INVENTION

Another object of this invention is to provide a new and improved bending tool for semi-rigid coaxial cable, the use of which tool avoids the introduction of flattened areas onto such cable.

Still another object of this invention is to provide a new and improved bending tool for semi-rigid coaxial cable, which tool is unitary, can be inexpensively manufactured, and can be used for providing multiple radii bends to coaxial cables of different diameters.

Yet another object of this invention is to provide a new and improved tool for semi-rigid coaxial cable, which tool selectively can be firmly hand held or securely held in a vise.

In accordance with one aspect of this invention, a coaxial cable bending tool includes a mandrel around which a semi-rigid coaxial cable may be bent or otherwise shaped. The mandrel, which extends along a fixed path, has an enlarged base portion adapted to be held to provide stability thereto. The mandrel includes a series of superimposed cylindrical portions of gradually diminishing diameters along the path. Each of the cylindrical portions is formed with a circumferential groove.

With certain features of the invention, the fixed path is along a linear axis of the mandrel. Each circumferential groove has a like width and a like depth to another of the grooves. The base portion can include opposed flats formed thereon to provide stability in the event the base portion were to be held in a vise. The base portion includes a knurled surface to provide for stability in the event the base portion were to be hand held. With other features, each groove is defined by a first respective portion including opposed sidewalls spaced apart a fixed width, the opposed sidewalls being parallel to a fixed depth, each groove being further defined by a second respective portion coupled to respective sidewalls to form, in cross-section, a joining semi-circular bed having a radius equal to one-half the width.

In accordance with another aspect of the invention, a mandrel for semi-rigid coaxial cables is set forth as an article of manufacture. The mandrel has an enlarged, generally cylindrically shaped support portion. The support portion has opposed flats formed thereon to provide for stability in the event the support portion were to be secured in a vise. Further, the support portion is formed with a knurled surface about its cylindrical periphery to provide for stability in the event the support portion were to be hand held. The mandrel includes a series of superimposed cylindrical portions of gradually diminishing diameters along one direction of a linear axis along which the mandrel extends. The mandrel includes a second series of gradually diminishing diameters along the opposite direction of the linear axis. Each cylindrical portion is formed with a circumferential groove. Each groove of the first series has a like width and a like depth as another groove of the first series. Each groove of the second series has a like width and a like depth as another groove of the second series. The like width of each groove of the first series is not equal to the like width of each groove of the second series. Likewise, the like depth of each groove of the first series is not equal to the like depth of each groove of the second series.

In accordance with certain features of the invention, the dimensional relationships are such that the like width of each groove of the first series is w, the like depth of each groove of the first series is d, the like width of each groove of the second series is W, and the like depth of each groove of the second series is D, wherein $2d > w$ and $2D > W$. Each groove of the first series is defined by a first respective portion including opposed sidewalls that are parallel to a depth of $(d-w/2)$ and a second respective portion coupled to the sidewalls to form, in cross-section, a joining semi-circular bed having a radius $(w/2)$. Each groove of the second series is defined by a third respective portion including opposed sidewalls that are parallel to a depth of $(D-W/2)$, and a fourth respective portion coupled to the sidewalls to form, in cross-section, a joining semi-circular bed having a radius $(W/2)$. With certain features, w is equal to 0.150 inch, d is equal to 0.125 inch, W is equal to 0.095 inch, and D is equal to 0.0625 inch.

BRIEF DESCRIPTION OF THE DRAWING

Other objects, advantages, and features of this invention, together with its construction and mode of operation, will be come more apparent from the following description, when read in conjunction with the accompanying drawing, in which.

DESCRIPTION OF PREFERRED EMBODIMENT(S)

Figure 1:
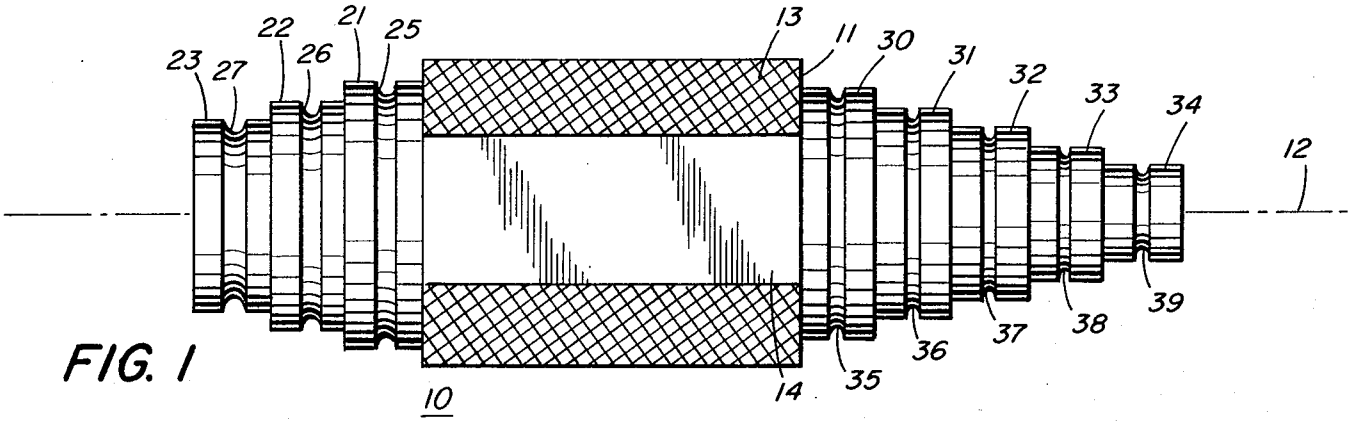
FIG. 1 is a plan view of a bending tool constructed in accordance with the invention.
Figure 2:
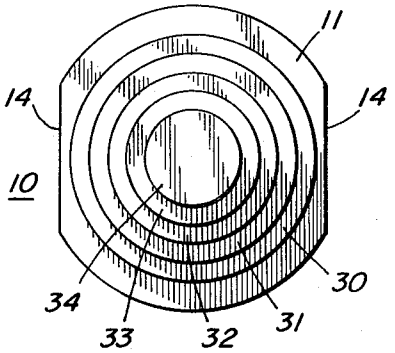
FIG. 2 is an end view of the tool depicted in FIG. 1, as viewed from the right side.

Referring to FIGS. 1 and 2, there is depicted a bending tool 10 suitable for bending semi-rigid coaxial cable (not shown). The tool 10 is shown in plan view in FIG. 1 and a right side view thereof is depicted in FIG. 2.

The tool 10, in one mode constructed by the inventor, was formed of a two inch aluminum rod. Other solid materials can be used, conditioned upon the material's strength, durability, cost, and machinability.

The tool 10 is designed to facilitate bends of semi-rigid coaxial cable with minimal effort and with minimal damage to the cable.

The tool 10 is used as a mandrel. A mandrel, as defined by *Webster's New International Dictionary of the English Language Second Edition*, includes a metal bar, used as a core around which metal or other material may be cast, molded, forged, bent, or otherwise shaped. As used herein, however, the term mandrel is defined broadly to include both a metal bar and a non-metallic bar, and can include synthetic material bars of plastic and ceramic. Preferably, the mandrel is a sturdy bar used as a core around which semi-rigid coaxial cable may be bent or otherwise shaped.

The tool 10 has a centrally located, enlarged, generally cylindrically shaped support portion 11. The tool 10 is symmetrical about a linear axis 12.

The support portion 11 is formed with a knurled surface 13 about its cylindrical periphery to provide for stability in the event the support portion 11 of the tool 10 is hand held.

To facilitate stability when secured in a vise (not shown), the tool 10 is provided with a pair of opposed flats 14, 14 along the support portion 11.

The mandrel 10 is formed with a first series of superimposed cylindrical portions 21, 22, 23 of gradually diminishing diameters along the axis 12, in a direction away from the support portion 11.

The mandrel 10 is formed with a second, unlike series of superimposed cylindrical portions 30, 31, 32, 33, 34 of gradually diminishing diameters along the axis 12 in the opposite direction, away from the support portion 11, as viewed in FIGS. 1 and 2.

Each cylindrical portion 21, 22, 23 is formed with a respective circumferential groove 25, 26, 27. Each groove 25, 26, 27 has the same width and the same depth as another groove of the first series, a representative groove 25 being depicted in an enlarged, fragmentary view in FIG. 3.

Each cylindrical portion 30, 31, 32, 33, 34 is formed with a respective circumferential groove 35, 36, 37, 38, 39. Each groove 35, 36, 37, 38, 39 has the same width and the same depth as another groove of the second series, a representative groove 35 being depicted in an enlarged, fragmentary view in FIG. 4.

As indicated in the drawing, the like widths and like depths of the first series of grooves 25, 26, 27 and of the second series of grooves 35, 36, 37, 38, 39 are not equal. In a preferred mode, considered suitable for bending of both 0.141" O.D. and 0.086" O.D. semi-rigid coaxial cable, the width w of each of the grooves 25, 26, 27 is 0.150 inch, the depth d of each of the grooves 25, 26, 27 is 0.125 inch. The width W of each of the grooves 35, 36, 37, 38, 39 is 0.095 inch, and the depth D of each of the grooves 35, 36, 37, 38, 39 is 0.0625 inch.

The width of a groove should be less than (but can be equal to) twice the depth thereof.

Figure 3:
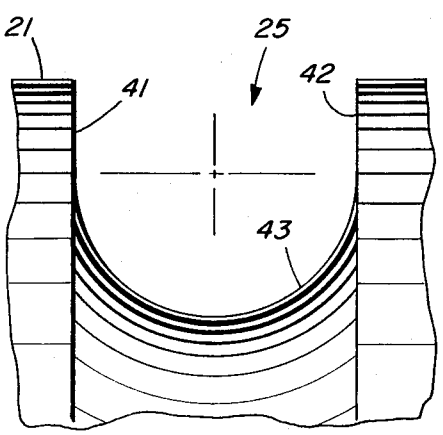
FIG. 3 is an enlarged fragmented view of a portion of the tool depicted in FIG. 1.
Figure 4:
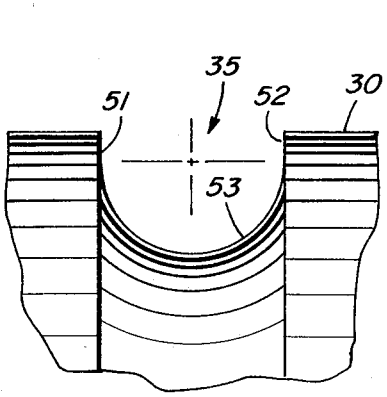
FIG. 4 is an enlarged fragmented view of another portion of the tool depicted in FIG. 1.

Each of the grooves 25, 26, 27 of the first series, as depicted in FIG. 3, includes a first respective portion including opposed sidewalls 41, 42 that are parallel to a depth of (d-w/2), and a second respective portion 43 coupled to the sidewalls 41, 42 to form, in cross-section (as viewed in FIG. 3), a joining semi-circular bed having a radius (w/2). The first portion distance, in the example set forth above, is 0.05 inch; the second portion radius in such example is 0.075 inch. Each of the grooves 35, 36, 37, 38, 39 of the second series, as depicted in FIG. 4, includes a third respective portion including opposed sidewalls 51, 52 that are parallel to a depth of (D-W/2), and a fourth respective portion 53 coupled to the sidewalls 51, 52 to form, in cross-section (as viewed in FIG. 4), a joining semi-circular bed having a radius (W/2). The third portion distance, in the example set forth above is 0.015 inch; the fourth portion radius in such example is 0.0475 inch.

The width of each of the grooves 25, 26, 27 in the example set forth above is 0.150 inch, considered suitable for the bending of a semi-rigid coaxial cable having an outside diameter of 0.141 inch. The width of each of the grooves 35, 36, 37, 38, 39 in the above example is 0.095 inch, considered suitable for the bending of a semi-rigid coaxial cable having an outside diameter of 0.086 inch. The reasons why the width of a groove is larger than the diameter of a cable are to provide both for differences in tolerances of both cable and tool manufacture, and to provide for the expansion or deformation of a cable while being bent.

A typical semi-rigid coaxial cable, suitable for use with the bending tool of this invention, has a bare center copper conductor and an outer, solid, thin walled, copper tube.

In summary, the tool 10 can be hand held, at its base or support portion 11, about its knurled surface 13. Alternatively, the tool 10 can be held in a vise, about the opposed flats 14, 14 to provide stability. A large diameter cable can be bent about any of the grooves 25, 26, 27 of different radii, depending upon the radius of bend desired. A smaller diameter cable can be bent about any of the second series of grooves 35, 36, 37, 38, 39 of different radii, depending upon the radius of bend desired.

The grooves can be provided upon the bending tool by various methods including milling. Whereas, in the past, the bending of a semi-rigid coaxial cable about a cylindrical surface yielded a flattened area on the coaxial cable producing a variety of transmission line problems, the provision of carefully milled grooves obviates the problems of the past by uniformly distributing pressure on the cable during bending.

What is claimed is:

1. As an article of manufacture, a mandrel for semi-rigid coaxial cables, said mandrel having an enlarged, generally cylindrically shaped support portion, said mandrel extending along a linear axis, said support portion having opposed flats formed thereon to provide for stability in the event said support portion were to be secured in a vise, and said support portion being formed with a knurled surface about its cylindrical periphery to provide for stability in the event said support portion were to be hand held, said mandrel including a first series of superimposed cylindrical portions of gradually diminishing diameters along a first direction along said axis, said mandrel including a second series of superimposed cylindrical portions of gradually diminishing diameters along a second direction along said axis, said second direction being opposite to said first direction, each of said cylindrical portions being formed with a circumferential groove, each said groove of said first series having a like width and a like depth as another groove of said first series, and each said groove of said second series having a like width and a like depth as another groove of said second series, wherein said like width of each said groove of said first series is not equal to said like width of each said groove of said second series, and wherein said like depth of each said groove of said first series is not equal to said like depth of each said groove of said second series.

2. The article as recited in claim 1, wherein said like width of each said groove of said first series is w, said like depth of each said groove of said first series is d, said like width of each said groove of said second series is W, said like depth of each said groove of said second series is D, and wherein $2d > w$ and $2D > W$.

3. The article as recited in claim 2, wherein each said groove of said first series is defined by a first respective portion including opposed sidewalls that are parallel to a depth of $(d - w/2)$ and a second respective portion coupled to said sidewalls to form, in cross-section, a joining semi-circular bed having a radius $(w/2)$, and wherein each said groove of said second series is defined by a third respective portion including opposed sidewalls that are parallel to a depth of $(D - W/2)$ and a fourth respective portion coupled to said third portion sidewalls to form a joining semi-cylindrical bed having a radius $(W/2)$.

4. The article as recited in claim 3, wherein w is equal to 0.150 inch, d is equal to 0.125 inch, W is equal to 0.095 inch, and D is equal to 0.0625 inch.

* * * * *